US005346004A

United States Patent [19]

Borden et al.

[11] Patent Number: 5,346,004

[45] Date of Patent: Sep. 13, 1994

[54] ENVIRONMENTALLY SECURE POLISHED ROD LINER HEAD

[75] Inventors: B. Michael Borden, 4075 W. Hillside Dr., Sapulpa, Okla. 74066; Brian C. Borden; Ricky D. Page, both of Glenpool, Okla.

[73] Assignee: B. Michael Borden, Sapulpa, Okla.

[21] Appl. No.: 47,648

[22] Filed: Apr. 13, 1993

[51] Int. Cl.[5] ..... E21B 33/00

[52] U.S. Cl. ..... 166/84

[58] Field of Search ..... 166/80–88, 166/7.5, 79

[56] References Cited

U.S. PATENT DOCUMENTS

| | | | |
|---|---|---|---|
| 1,708,261 | 4/1929 | Crowell et al. . | |
| 3,163,430 | 12/1964 | Normand | 277/19 |
| 3,468,374 | 9/1969 | Reeves | 166/84 |
| 3,662,829 | 5/1972 | Gault et al. | 166/84 |
| 3,939,910 | 2/1976 | Bruce | 166/84 |
| 4,099,562 | 7/1978 | Mattoon | 166/84 |
| 4,109,713 | 8/1978 | Clow | 166/53 |
| 4,345,766 | 8/1982 | Turanyi | 166/84 X |
| 4,889,184 | 12/1989 | Lugtmeier et al. | 166/84 X |
| 4,907,650 | 3/1990 | Heinonen | 166/80 |
| 5,137,083 | 8/1992 | Bump | 166/84 |
| 5,141,052 | 8/1992 | Bump | 166/84 X |

*Primary Examiner*—Thuy M. Bui
*Attorney, Agent, or Firm*—Head & Johnson

[57] ABSTRACT

An environmentally secure polished rod liner head is provided for use on a polished rod employed in an oil well pumping system for vertically reciprocating a string of sucker rods, the polished rod extends through a stuffing box, the polished rod liner head having a body with a passageway therethrough receiving the polished rod, a polished rod liner removably secured to the lower end of the body and encompassing the polished rod, bolts extending laterally through the upper end of the body to secure the body to a polished rod so that the polished rod liner is reciprocated with the polished rod and a closure member within the body passageway above the polished rod liner biased to close in the event the polished rod should be unexpectedly removed from the body to thereby prevent hydrocarbons from being discharged through the polished rod liner and into the atmosphere. In one embodiment the environmentally secure polished rod liner head has a conically tapered internal surface and tapered wedges nesting therein to grip the polished rod to prevent it from falling downwardly through a stuffing box if the polished rod breaks above the stuffing box or becomes loose from the clamp that attaches it to a well pumping system.

17 Claims, 4 Drawing Sheets

ENVIRONMENTALLY SECURE POLISHED ROD LINER HEAD

BACKGROUND OF THE INVENTION

Petroleum is typically found in subterranean formations in which it has accumulated, having been formed by entrapped organic matter that is buried in the earth as geological changes occur. Wells are drilled from the earth's surface to penetrate the hydrocarbon (petroleum) bearing formations. Most formations, in their natural state, contain the hydrocarbons under pressure, that is, there is formation pressure so that initially when a borehole penetrates a formation, sufficient subterranean pressure exists to force the flow of oil and/or gas to the earth's surface. However, in many hydrocarbon formations the subterranean pressure eventually is reduced as oil and/or gas are withdrawn from the formation. When the formation pressure is insufficient to force hydrocarbon fluids to the earth's surface in commercial quantities, they must be pumped. While liquid petroleum can be pumped to the earth's surface by a variety of pumping means, one of the most commonly employed is that using a reciprocating pump that is positioned within a tubing string extending from the earth's surface to the producing formation. The pump is typically actuated by a string of sucker rods that are reciprocated within the tubing string. The lower end of the sucker rod string is attached to the pump. The upper end of the sucker rod string extends to, or at least approximately to, the earth's surface. At the earth's surface some means must be provided to accommodate the reciprocation of the sucker rod string and yet permit pumped fluid to pass from the top of the tubing string for collection. For this purpose, a pumping "T" is attached to the upper end of the tubing string providing a connection for a leadline, or other conduit, to carry produced fluids and/or gases away from the well. Attached to the top of the pumping "T" is a stuffing box. Reciprocated within the stuffing box is a cylindrical polished rod having a smooth outer surface. The lower end of the polished rod is attached to the upper end of the sucker rod string, and the upper end is secured to a pumping unit so that the polished rod is reciprocated vertically within the stuffing box to thereby reciprocate the sucker rod string and the pump attached to it. Packing within the stuffing box surrounds the polished rod to retain produced fluids and gases. The polished rod must be constructed of material specifically selected to provide the tensile strength required for the reciprocation of a string of sucker rods; accordingly, most polished rods are made of steel.

For many years it has been a custom in the petroleum industry to employ polished rod liners on the exterior of the polished rod. Polished rod liners are made of material having good wear characteristics to receive the rubbing action of the packing within the stuffing box, and a polished rod liner does not have to be of high strength material since tensile strength is not important.

In recent years, increased environmental concern has arisen in the petroleum industry. A major concern is that of the escape of hydrocarbons (fluids or gases) in the event of breakage of a polished rod. That is, if the polished rod breaks or if the polished rod comes lose from the mechanism that attaches it to the pumping unit by which it is reciprocated, the polished rod can fall downwardly through the stuffing box, leaving the stuffing box completely open so that hydrocarbons can escape to the atmosphere. To combat this problem, others have provided safety valves within the stuffing box that close in the event that a polished rod should break or otherwise be removed from the stuffing box. For examples of devices to prevent the escape of hydrocarbons in the event that a polished rod is inadvertently withdrawn from a stuffing box, see U.S. Pat. No. 5,141,052 entitled "Well Head Stuffing Box For Polished Rod and Accessories For Same" issued Aug. 25, 1992.

Another stuffing box having an integral valve with a mechanism for closing in the event that the polished rod falls out of the stuffing box is U.S. Pat. No. 4,907,650 entitled "Well Head For Safety Valve For Pumping Well" issued Mar. 13, 1990. For further background to this type of device the following patents are also relevant: U.S. Pat. Nos. 3,939,910; 4,109,713; 4,099,562; 1,708,261 and 4,889,184.

These prior issued patents are representative of the state of the art relating to the prevention of the escape of hydrocarbons from a well in the event of loss of a polished rod. However, the devices revealed in the prior issued patents will not function if a polished rod liner is used on a polished rod. If a polished rod is removed from a well pumping system that employs a polished rod liner, the polished rod liner can be left within the stuffing box, providing an open passageway for the escape of hydrocarbons. With the polished rod liner remaining in the stuffing box, the closure devices, as illustrated in the above mentioned patents, cannot close and, therefore, fluids and/or gases are free to escape.

A basic object of this invention is to provide a polished rod liner head for use in attaching a polished rod liner to a polished rod that will automatically close the passageway through the polished rod liner in the event the polished rod is removed to thereby prevent the flow of fluids or gases through the polished rod liner.

Another basic object is to provide a polished rod liner head having means to prevent the polished rod from slipping out of the head in the event the polished rod breaks above the polished rod liner or become loose from the polished rod clamp.

SUMMARY OF THE INVENTION

This invention provides an environmentally secure polished rod liner head. The liner head is in the form of a body member having a passageway therethrough for receiving a polished rod. The body member lower end has provision for the attachment of a tubular polished rod liner. The polished rod liner has a tubular interior that receives a polished rod on which the liner is positioned.

Bolts received in threaded openings in the upper portion of the body member are employed for attaching the body member to the polished rod so that it is reciprocated with the polished rod and thereby the polished rod liner is reciprocated, the polished rod liner being received in an oil well pumping system stuffing box.

Interiorly of the body member is a closure element, that is, a valve-like flapper element that is pivotally secured to the body member interior. The flapper element has an opened and closed position. In the opened position the closure member is exterior of the polished rod that is received within the body member. Upon removal of the polished rod, the closure member is pivoted to the closed position, shutting off the passageway through the body. In this manner, if a polished rod is removed from the polished rod liner head body, such as by breakage of the polished rod or disconnection from its attachment to the pumping system, the interior of the polished rod liner is closed against the passage of fluid or gases into the atmosphere.

In a preferred embodiment of this invention, a means is provided to more securely retain the polished rod within the polished rod liner so that if the polished rod breaks above the polished rod liner or becomes disconnected from the pumping mechanism, the polished rod liner head will be retained by the stuffing box through which the polished rod liner extends and the polished rod will be captured so as to prevent it from falling downwardly out of the polished rod liner. For this purpose, a series of circumferentially placed wedges are provided in the body member lower end, the wedges being configured to grasp against the exterior surface of the polished rod and to increase the pressure of contact in response to the wedge-shaped arrangement as the polished rod attempts to pass vertically downwardly through the polished rod liner head.

A better understanding of the invention will be had by reference to the following description of the preferred embodiment, taken in conjunction with the attached drawings.

DESCRIPTION OF THE PREFERRED EMBODIMENT

Figure 1:
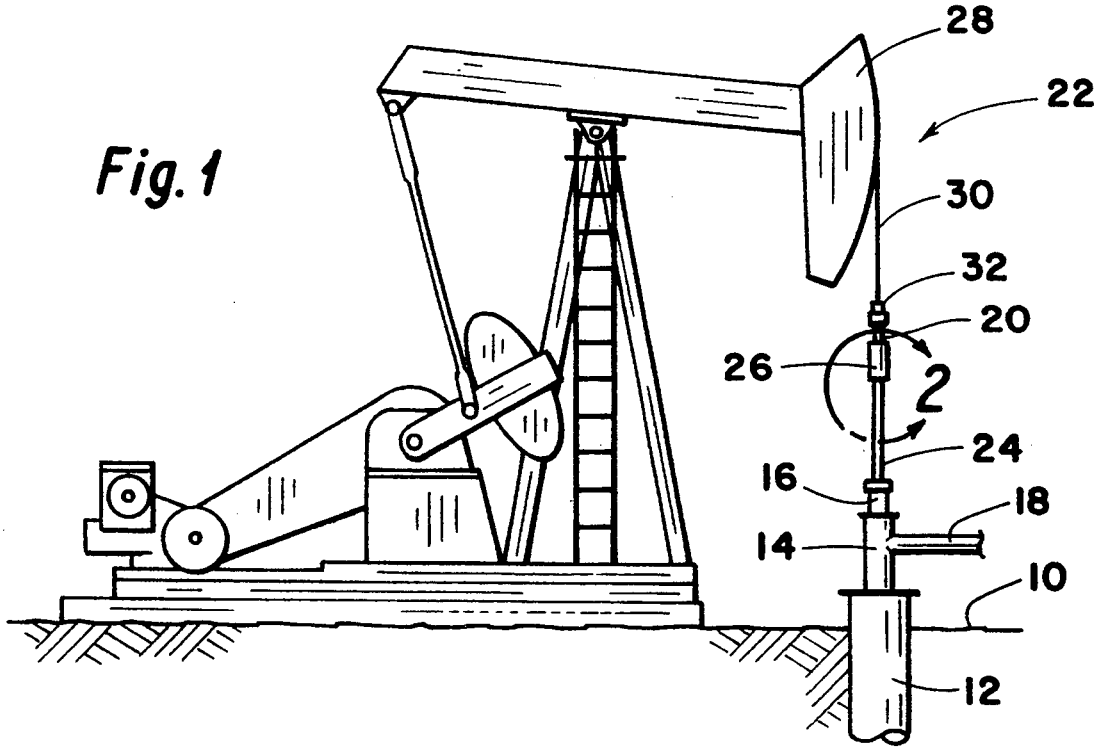
FIG. 1 is an elevational view of a typical oil well pumping system by which a subsurface pump (not shown) is vertically reciprocated and shows the environmentally secure polished rod liner head of this invention.

Referring first to FIG. 1, a typical oil well pumping system that provides the environment in which the present invention is employed is illustrated. Extending from the earth's surface 10 a vertical casing 12 receives a tubing string 14 that extends from the earth's surface into a hydrocarbon producing subterranean formation (not shown). At the upper end of tubing string 14 is a stuffing box 16. Below the stuffing box a leadline conduit 18 extends from the well and passes to a storage tank (not shown), pipeline (not shown) or other means of conducting produced hydrocarbon fluids and/or gases away from the well.

After a drilled well looses subterranean pressure that is sufficient to force the formation fluids to the earth's surface, it is necessary to pump the well to extract the hydrocarbons. The most usual means for accomplishing this is to vertically actuate a positive displacement pump at the lower end of tubing string 14 to lift the subterranean formation fluid to the earth's surface 10 where it is carried away in conduit 18. For this purpose, a string of sucker rods (not shown) is received within tubing 14, the lower end of the string of sucker rods being attached to a bottom hole pump (not shown), with the upper end being attached to the lower end of a polished rod 20. The function of polished rod 20 is to convey reciprocating motion from a well pumping unit, generally indicated by the numeral 22, to the sucker rod string attached at the lower end thereof. Since reciprocating motion must be passed through stuffing box 16, it is common for the stuffing box to include elastomeric sealing members (not shown) that closely engage the outer surface of the polished rod 20 to prevent the escape of fluids and/or gases therepast but, at the same time, to permit the polished rod to be reciprocated. It has long been a custom of many oil well producers to employ a tubular polished rod liner 24 that is received within stuffing box 16. The polished rod liner 24 may be made of brass or other material that has high wear and corrosion resistance. The polished rod liner 24 must be secured to polished rod 20 so as to be reciprocated with it. For this purpose, a polished rod liner head 26 is employed.

One of the problems with the arrangement of FIG. 1 is that if polished rod 20 should break above polished rod liner head 26, the polished rod would fall downwardly within tubing 14, leaving polished rod liner 24 and polished rod liner head 26 fully opened so that hydrocarbons could escape from the interior of the well into the atmosphere. This invention is concerned with an improved polished rod liner head 26 that is environmentally secure so as to prevent the inadvertent passage of hydrocarbons from a well in the event a polished rod breaks.

In order to reciprocate polished rod liner head 26 it must be attached to the pumping system. A typical pumping system includes a horse head 28 with a cable or cables 30 extending therefrom. The lower end of the cables are attached to a polished rod clamp 32. If polished rod clamp 32 should fail, allowing polished rod 20 to be released, the downward weight on the polished rod would cause it to immediately be pulled out of polished rod liner head 26 and polished rod liner 24 to create the circumstances in which hydrocarbons could escape through polished rod liner 24. FIGS. 2 through 7 illustrate an improved liner head that guards against inadvertent discharge of hydrocarbons into the atmosphere.

Figure 2:
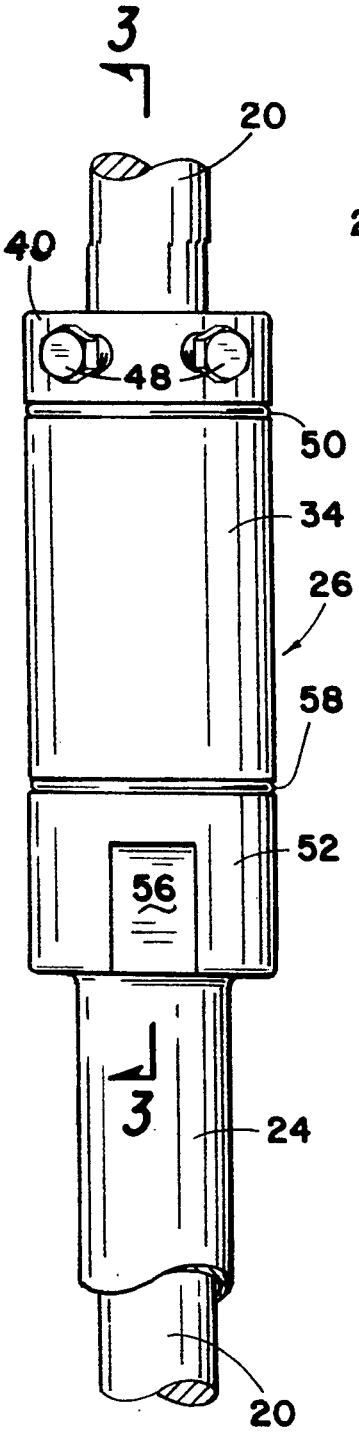
FIG. 2 is an external view of the environmentally secure polished rod liner head of this invention showing it as received on a polished rod. This Figure shows also a polished rod liner supported by the head and received on a polished rod, only a fraction of the length of the liner being shown.
Figure 3:
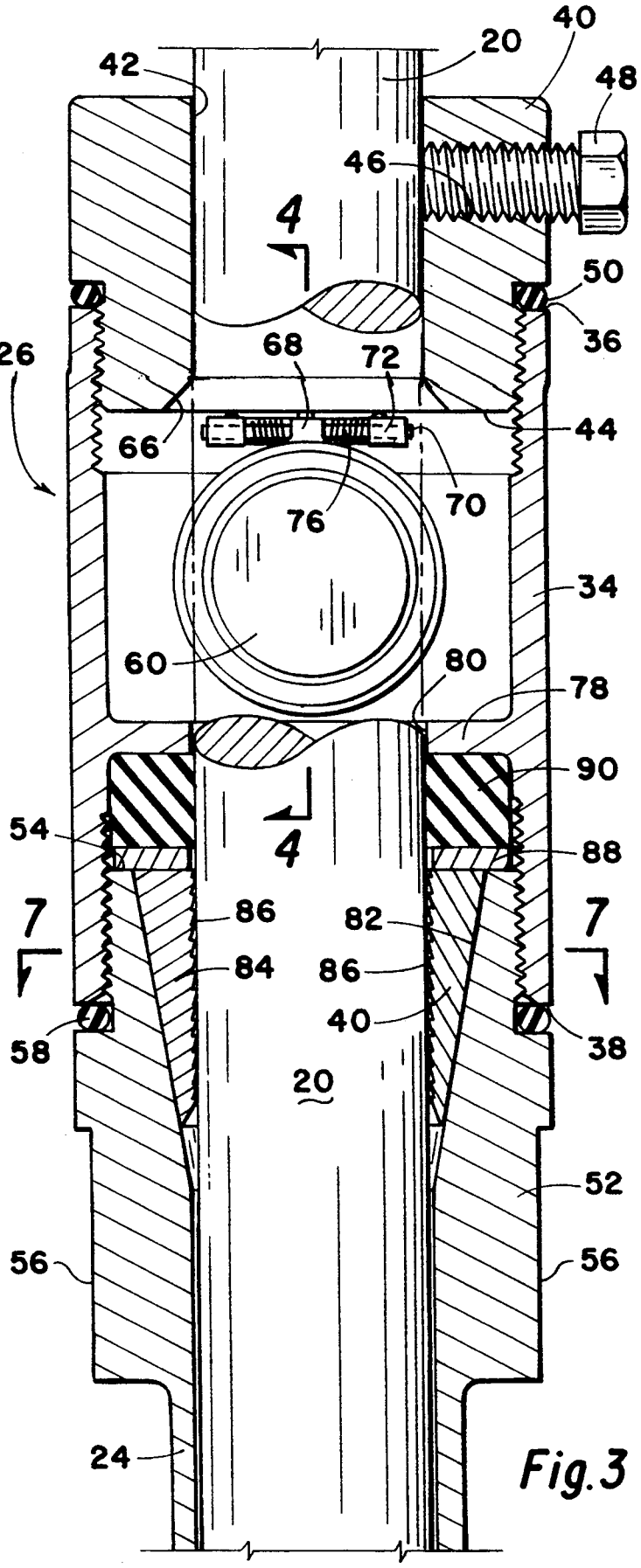
FIG. 3 is an enlarged cross-sectional view taken along the line 3—3 of FIG. 2 showing details of the interior arrangement of the environmentally secure polished rod liner head of this invention.

Referring first to FIGS. 2 and 3, it will be seen that polished rod liner head 26 has a tubular body member 34 having an internally threaded upper end 36 and an internally threaded lower end 38. Another basic element of polished rod liner head 26 is a tubular upper body portion 40 having a passageway 42 therethrough. The lower end 44 of upper body portion 40 is externally threaded and threadably engages internally threaded upper end 36 of body member 34. Radially extending spaced apart threaded openings 46 formed in upper body portion 40 receive bolts 48 that engage the exterior surface of polished rod 20, providing a means of attachment of polished rod liner head 26 to the polished rod. At least three such spaced apart openings 46 and bolts 48 are preferred, four being shown in FIG. 6.

An elastomeric member, such as an O-ring 50, is employed between upper end of body portion 34 and upper body portion 40 to seal the two members together to prevent leakage.

As previously stated, the main function of polished rod liner head 26 is to secure polished rod liner 24 to polished rod 20. This can be done in a variety of ways. In the method illustrated in FIGS. 2 and 3, polished rod liner 24 has an integral enlarged diameter upper coupling portion 52 that is externally threaded at its upper end 54 that is threadably received in body member lower threaded end 38. The enlarged diameter coupling portion 52 is preferably provided with opposed wrench flats 56 (see FIG. 2) as a means of threadably engaging the polished rod liner coupling portion 52 to the lower end of body member 34. An elastomeric member, such a O-ring member 58, is employed to seal these two members together.

Figure 6:
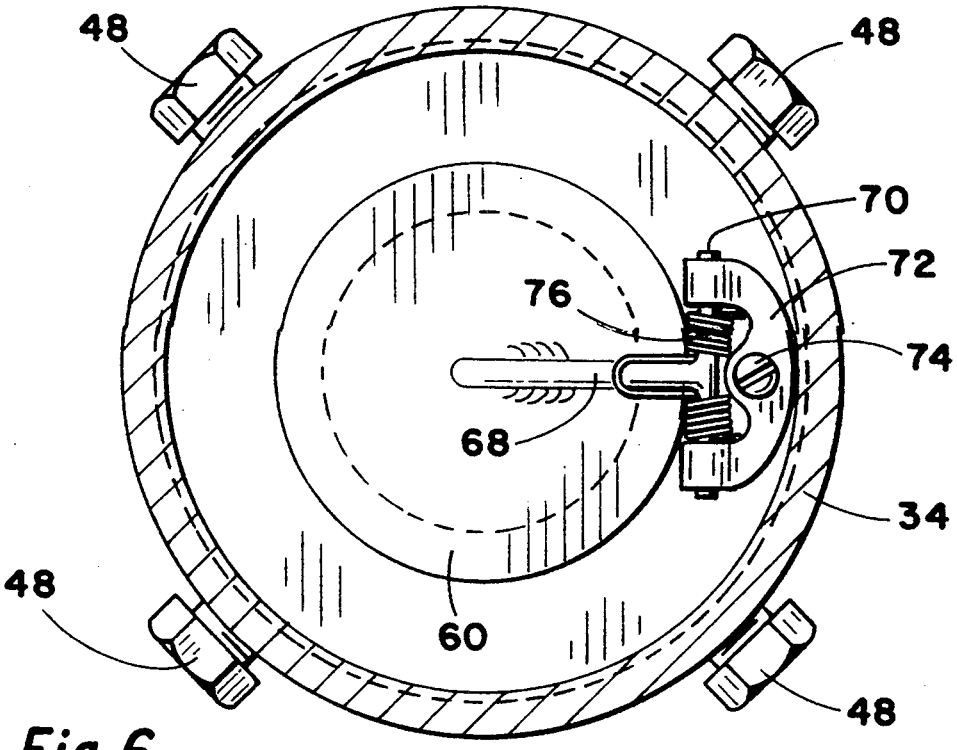
FIG. 6 is a horizontal cross-sectional view taken along the line 6—6 of FIG. 5 showing the interior of the liner head body when the sucker rod is not received therein and showing the valve in the closed position.
Figure 5:
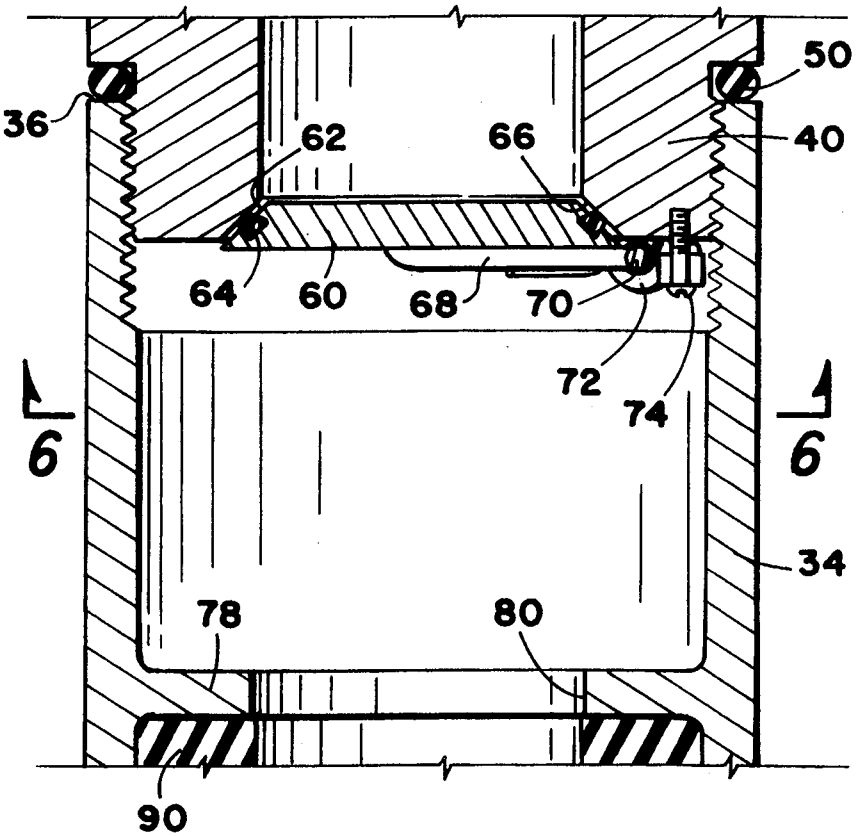
FIG. 5 is a view as shown in FIG. 4 but showing the interior of the polished rod liner head with the polished rod removed and showing the valve mechanism in the closed position.
Figure 4:
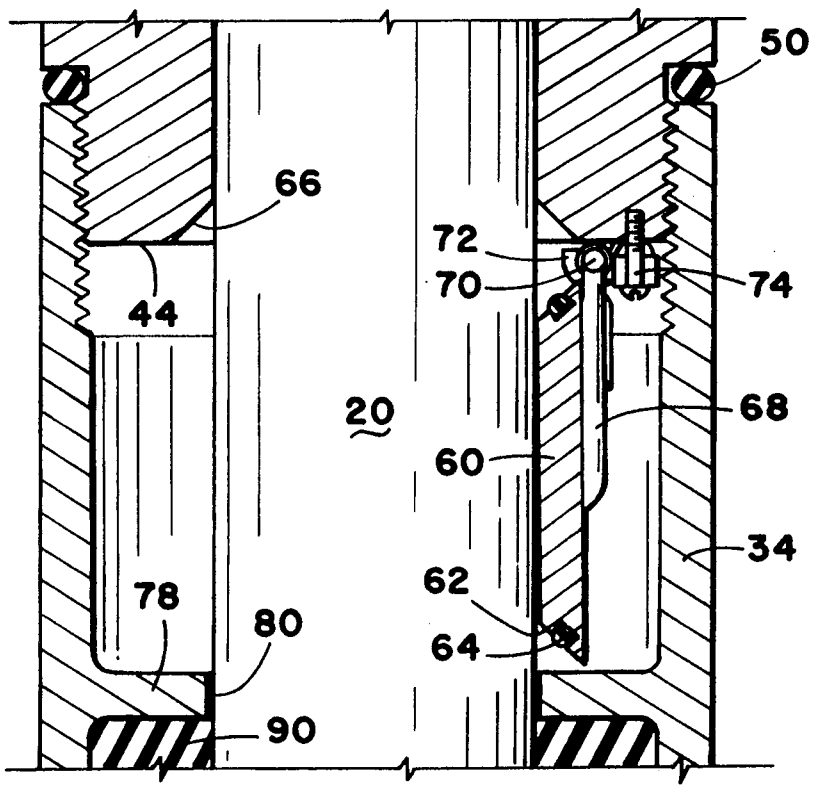
FIG. 4 is an elevational cross-sectional view taken along the line 4—4 of FIG. 3 showing more details of the interior of the polished rod liner head and the valve mechanism for closing the interior passageway in the event the polished rod is inadvertently removed.

Pivotally supported within the interior of body member 34 is a valve element 60, illustrated in detail in FIGS. 4, 5 and 6. Valve element 60 is in the form of a flat, circular disc having a sealing face 62 that, in the embodiment illustrated, receives a circumferential O-ring 64. Surrounding passageway 42 through upper body portion 40, at the lower end 44 of upper body portion 40, is a circumferential sealing surface 66. (See FIG. 3).

A bracket 68 extends from the valve element rearward surface and is mounted on a hinge pin 70. A clamp member 72 is affixed to the upper body portion lower end 44 by means of a bolt 74. Thus, valve element 60 is pivotally supported at the lower end of upper body portion 40 within the interior of tubular body member 34. The valve element is movable between an opened position, as shown in FIGS. 3 and 4, and a closed position, as shown in FIGS. 5 and 6. The opened position is maintained as long as polished rod 20 is present within the interior of polished rod liner head 26, as shown in FIGS. 2, 3 and 4. When the polished rod is removed from the polished rod liner head, such as because of breakage of the polished rod or failure of the polished rod liner clamp 32, valve element 60 immediately moves to the closed position, as shown in FIGS. 5 and 6. To ensure positive closure, a coiled spring 76 is secured around hinge pin 70 and is arranged to apply closing bias to valve element 60. In the closed positioned valve element sealing face 62 sealably engages sealing surface 66 of upper body portion 40 to close the passageway through polished rod liner clamp 32 and to thereby prevent inadvertent escape of hydrocarbons into the atmosphere.

The environmentally secure polished rod liner head as described provides a means of closing the interior of a polished rod liner if the polished rod to which it is secured breaks, becomes uncoupled or is otherwise inadvertently withdrawn from the interior of the polished rod liner. Closing polished rod liner head 26 accomplishes a function that is different than closing a stuffing box when the polished rod is removed. Closure members formed as a part of stuffing boxes, such as in the prior issued patents referenced in the background portion of this disclosure, cannot function if a polished rod liner remains within the stuffing box even though the polished rod itself is removed. Thus, the environmentally secure polished rod liner head as described herein achieves a degree of protection against the inadvertent escape of hydrocarbons that is not possible with the employment of a valve element within a stuffing box.

Figure 7:
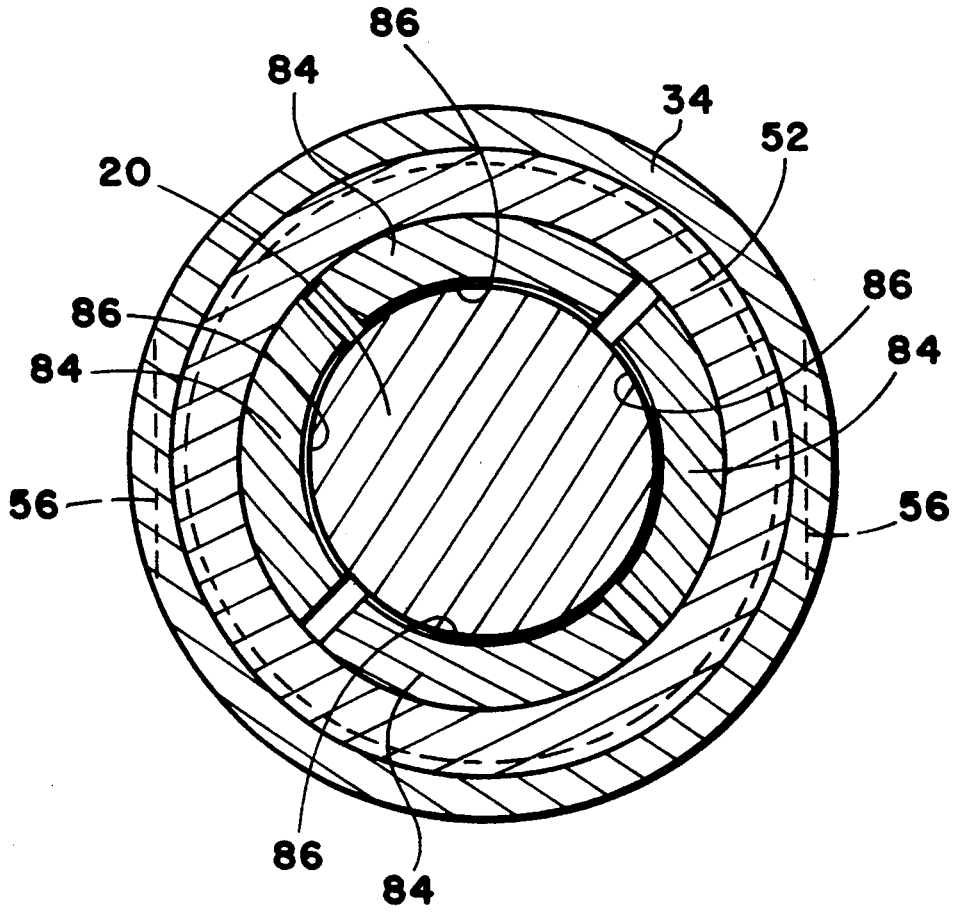
FIG. 7 is a cross-sectional view taken along the line 7—7 of FIG. 3 showing the use of a plurality of tapered wedges providing means to more securely attach the polished rod liner head to a polished rod so as to reduce the likelihood that the polished rod will be inadvertently removed from the liner head.

FIGS. 3 and 7 provide an additional safety feature of the environmentally secure polished rod liner head. As shown in FIG. 3, in the illustrated embodiment tubular body member 34 has an integral inwardly extending circumferential ledge 78 having an opening 80 therethrough receiving polished rod 20. The polished rod liner coupling portion 52, at upper end 54 thereof, includes an internally tapered surface 82. This internally tapered surface 82 is frusto-conical in shape, tapering downwardly and inwardly.

Received within internally tapered surface 82 are a plurality of circumferential wedges 84. While at least three of such wedges are required, FIG. 7 illustrates the use of four spaced apart wedges 84. Each of the tapered circumferential wedges 84 has a serrated inner surface 86 that engages the exterior cylindrical surface of polished rod 20.

The function of wedges 84 is to securely grasp polished rod 20 if it is moved downwardly with force against polished rod liner coupler portion 52. Normally, the polished rod liner, including head portion 26, reciprocates with the polished rod and retaining the liner in position on the polished rod is relatively easy. Thus, bolts 48, as previously described, normally are sufficient to retain the polished rod and polished rod liner together. The purpose of the tapered wedges 84, in the arrangement illustrated in FIGS. 3 and 7, is to provide an additional degree of safety. In the event that the polished rod should break above the polished rod liner or become uncoupled from polished rod clamp 32, as shown in FIG. 1, the entire polished rod and polished rod liner with the polished rod liner head 26 would move immediately downwardly as the polished rod is pulled by the weight of the sucker string attached to it. When polished rod liner coupling portion 52 engages stuffing box 16, as shown in FIG. 1, it will be stopped. Wedges 84 will grasp the exterior of polished rod 20 and catch the polished rod so that it does not pass downwardly through the polished rod liner upper portion 54. If the polished rod is captured in this manner, not only does such prevent the passage of hydrocarbons out through the polished rod liner but it saves the operator substantial money that is normally employed in fishing a broken polished rod out of the interior of the tubing string. Thus, the use of wedges 84 in internally tapered coupling portion 82 is an ancillary safety feature of the embodiment of the environmentally secure polished rod liner head as specifically shown in FIGS. 3 and 7. In one embodiment of the environmentally secure polished rod liner head the tapered wedges may not be employed, and in like manner, the polished rod liner head in another embodiment can be provided with the tapered wedges but without the use of a valve element.

FIG. 3 shows polished rod liner 24 having integral coupling portion 52. This is by way of example only. The lower end of the coupling portion may be internally threaded and the upper end of the polished rod liner externally threaded so that polished rod liner 24 and coupling portion 52 may be separate elements threaded together or otherwise permanently attached to each other.

Another feature of the embodiment of FIG. 3 is the illustrated method of securely sealing the interior passageway of body member 34 to the exterior of polished rod 20. A washer 88 is received on the polished rod above liner upper end 54. An elastomeric member 90, such as of rubber, is received on the exterior of polished rod 20 between washer 88 and ledge 78. As liner coupling portion 52 is threaded onto lower end of body 34, the elastomeric member is compressed so as to provide a seal between the passageway within body portion 34 and the exterior of polished rod 20.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. For use with a polished rod employed in an oil well pumping system for vertically reciprocating a sucker rod string, the polished rod extending through a stuffing box, a polished rod liner head for supporting a tubular polished rod liner on the polished rod, comprising:

a body member having a vertical passageway therethrough for receiving a polished rod, the body member having an upper and a lower end;

means adjacent said body member lower end for attachment of a tubular polished rod liner having a tubular interior that receives the polished rod therein and to thereby communicate the tubular interior with said body member passageway;

means of affixing said body member to a polished rod to thereby support a polished rod liner thereon; and a closure member within said body member passageway having an opened and a closed position, the closure member being displaced to an open position when a polished rod is received in said passageway, the closure member moving to the closed position in the absence of a polished rod to thereby close said body member passageway and the polished rod liner tubular interior against the passage of fluid upwardly therethrough.

2. A polished rod liner head according to claim 1 wherein said closure means is spring loaded and biased towards the passageway closed position.

3. A polished rod liner head according to claim 1 including means to resist the downward vertical removal of a polished rod from said body member.

4. A polished rod liner head according to claim 1 wherein said body member includes an upper tubular body portion having a passageway therethrough forming a portion of said body passageway.

5. A polished rod liner head according to claim 4 wherein said opening through said upper body portion is defined in part by a circumferential valve seat and wherein said closure member is in the form of a disc member pivotally supported to said upper body portion and arranged, when in said closure member closed position, to sealably engage said valve seat.

6. A polished rod liner head according to claim 4 wherein said upper body portion has at least one threaded opening therein intersecting said passageway; and a threaded bolt received in each said threaded opening providing, at least in part, said means of affixing said body member to a polished rod.

7. A polished rod liner head according to claim 1 for use with a polished rod liner having a threaded upper end and wherein said body member lower end is threaded for threadably receiving a threaded polished rod liner.

8. For use with a polished rod employed in an oil well pumping system for vertically reciprocating the polished rod through a stuffing box, a polished rod liner system for mounting on the polished rod comprising:

a head member having an upper and a lower end and a passageway therethrough for receiving a polished rod;

a tubular polished rod liner having an upper end portion and means to secure the upper end portion to said head member lower end;

means to secure said head member to a polished rod for supporting said liner thereon; and closure means within said head member passageway having an opened and a closed position, the closure member being displaced to an open position when a polished rod is received in said passageway.

9. A polished rod liner system according to claim 8 wherein said closure means is spring loaded and biased towards said closed position.

10. A polished rod liner system according to claim 8 including means to resist the downward vertical removal of a polished rod from said body member.

11. A polished rod liner system according to claim 8 wherein said body member includes an upper tubular body portion having a passageway therethrough forming a portion of said body passageway.

12. A polished rod liner system according to claim 11 wherein said opening through said upper body portion is defined in part by a circumferential valve seat and wherein said closure member includes a disc member pivotally supported to said upper body portion and arranged, when in said closure member closed position, to sealably engage said valve seat.

13. A polished rod liner system according to claim 11 wherein said upper body portion has at least one threaded opening therein intersecting said passageway; and a threaded bolt received in each said threaded opening providing, at least in part, said means of affixing said body member to a polished rod.

14. A polished rod liner system according to claim 8 for use with a polished rod liner having a threaded upper end and wherein said body member lower end is threaded for threadably receiving said polished rod liner.

15. A polished rod liner system according to claim 10 wherein said polished rod liner upper end portion has a frusto-conical shaped passageway therethrough and including:

a plurality of wedge shaped segments within said frusto-conical passageway and exterior of a polished rod received therethrough and arranged to grip the polished rod in response of downward movement thereof with respect to the polished rod liner head end portion to thereby provide, at least in part, said means to resist the downward vertical removal of a polished rod from said polished rod liner system.

16. For use with a polished rod employed in an oil well pumping system for vertically reciprocating a sucker rod string, the polished rod extending through a stuffing box, a polished rod liner head for supporting a tubular polished rod liner on the polished rod, comprising:

a body member having a vertical passageway therethrough for receiving the polished rod, the body member having an upper and a lower end;

means adjacent said body member lower end for attachment of a tubular polished rod liner having a tubular interior that receives the polished rod therein;

means of affixing said body member to the polished rod to thereby support a polished rod liner thereon; and means to resist the downward vertical removal of the polished rod from within said body member, such means being of the type that increases removal resistance in proportion to removal force.

17. A polished rod liner head according to claim 16 wherein at least a portion of said vertical passageway through said body member is frusto-conical in configuration providing an interior surface that slopes downwardly and inwardly towards the polished rod received within said body member; and a plurality of wedge shaped segments within said frusto-conical passageway and exterior of the polished rod received therethrough and arranged to grip the polished rod in response of downward movement thereof with respect to the polished rod liner head body portion to thereby provide, at least in part, said means to resist the downward vertical removal of a polished rod from said polished rod liner head.

* * * * *